US008499506B2

(12) United States Patent
Maltini

(10) Patent No.: US 8,499,506 B2
(45) Date of Patent: Aug. 6, 2013

(54) MODULAR ELEMENT FOR MAKING FIXED LADDERS

(76) Inventor: Alessandro Maltini, Mori (IT)

( * ) Notice: Subject to any disclaimer, the term of this patent is extended or adjusted under 35 U.S.C. 154(b) by 15 days.

(21) Appl. No.: 12/733,985

(22) PCT Filed: Sep. 23, 2008

(86) PCT No.: PCT/EP2008/008048
§ 371 (c)(1),
(2), (4) Date: Jun. 7, 2010

(87) PCT Pub. No.: WO2009/043509
PCT Pub. Date: Apr. 9, 2009

(65) Prior Publication Data
US 2010/0242383 A1 Sep. 30, 2010

(30) Foreign Application Priority Data
Oct. 2, 2007 (IT) ..... MI2007A1884

(51) Int. Cl.
*E04F 11/16* (2006.01)

(52) U.S. Cl.
USPC ..... 52/182; 52/188; 211/52

(58) Field of Classification Search
USPC ..... 52/182, 188; 182/151; 211/52, 55, 211/183
See application file for complete search history.

(56) References Cited

U.S. PATENT DOCUMENTS 2,724,466 A * 11/1955 Phillips ..... 52/191
4,406,347 A * 9/1983 Stathopoulos ..... 182/1

FOREIGN PATENT DOCUMENTS

| | | | |
|---|---|---|---|
| DE | 31 05 646 | A1 | 8/1982 |
| DE | 195 23 573 | A1 | 1/1997 |
| DE | 20 2006 003497 | U1 | 6/2006 |
| EP | 733774 | A1 * | 9/1996 |
| EP | 942144 | A2 * | 9/1999 |
| FR | 2 572 443 | A | 5/1986 |

OTHER PUBLICATIONS

International Search Report.

* cited by examiner

*Primary Examiner* — Jeanette E Chapman
*Assistant Examiner* — Daniel Kenny
(74) *Attorney, Agent, or Firm* — William J. Sapone; Ware Fressola Maguire & Barber LLP

(57) ABSTRACT

A modular element (10) for making fixed ladders, made of steel or other suitable material, having a surface (12) and two opposite shaped supports (14, 16), provided with at least one rib developed along the inner face and forming a shelf (36) for bearing a further surface (12).

13 Claims, 5 Drawing Sheets

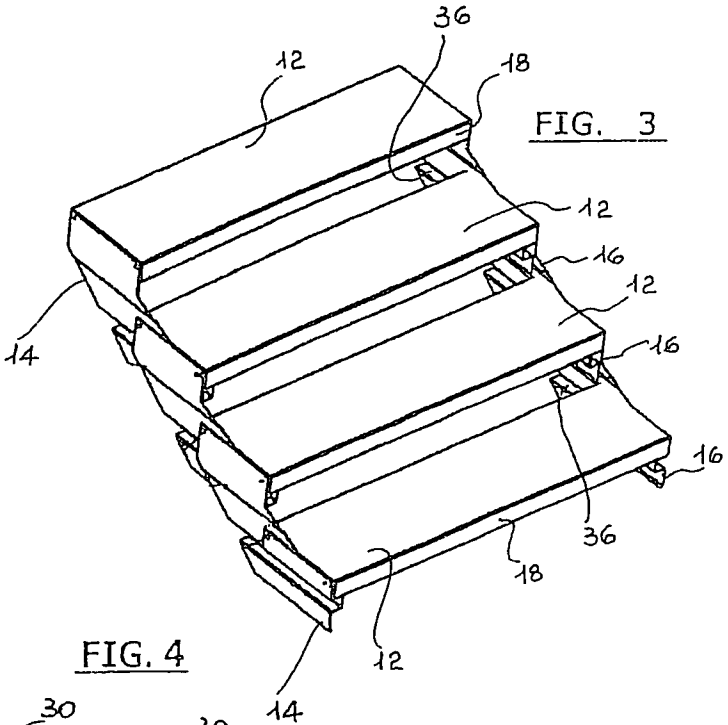
FIG. 1
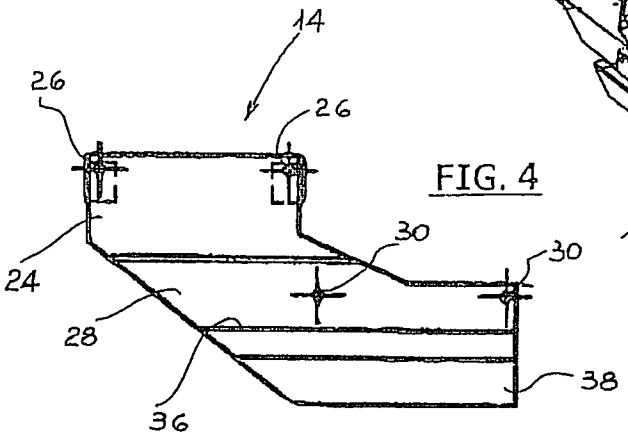
FIG. 4
FIG. 3

MODULAR ELEMENT FOR MAKING FIXED LADDERS

CROSS REFERENCE TO RELATED APPLICATIONS

This application is the National Stage of PCT/EP2008/008048 filed on Sep. 23, 2007. The international application under PCT article 21(2) was published in English under WO2009/043509 on Apr. 9, 2009.

TECHNICAL FIELD

This invention relates to a modular element for making fixed ladders.

More in particular, this invention relates to a metal modular element which, used in multiple assembled units identical to one another, results in a fixed ladder with rectilinear flights suitable for both industrial and civil use.

BACKGROUND ART

It is known that fixed metal ladders are used in different scopes, for example for safety and emergency purpose in the event of a fire in buildings; such ladders are entirely made of metal and are mainly installed outside buildings. Other fixed metal ladders find application inside the buildings themselves, to access mezzanine floors or ceilings, and as service access in shops, offices and public places.

Known ladders of this kind typically comprise a bearing structure or frame that supports a plurality of walking surfaces forming the steps; said ones are constrained to the bearing structure by welds and/or bolts.

It has been found that these known ladders show considerable drawbacks, both from the construction point of view and in the assembly or installation step.

As regards the construction aspect, said ladders involve the setup of multiple components, often of considerable size to be assembled to one another for making the bearing structure, whereas the multiple welds required to assemble said structure are difficult, require the work of specialised personnel as well as in-depth checks on the suitable resistance and hold.

Moreover, it should be noted that at said welds it is necessary to carry out protection operations with coatings suitable for preventing the deterioration thereof. Also the transport of the bearing structures to the installation site can be difficult as it requires specific means, considering the size of the components which can reach several metres in length. This also implies considerable overall costs.

DESCRIPTION

The object of this invention is to obviate the drawbacks mentioned hereinabove.

More in particular, the object of this invention is to provide a modular element for making fixed ladders which should prevent the need of setting up a bearing structure for the steps.

A further object of the invention is to provide a modular element which should allow, with the use of various modular elements identical to one another, constructing and installing on site a fixed ladder without the need of using welds.

Last but not least, another object of the invention is to provide a modular element for making fixed ladders of very and easy to be transported with other identical elements.

A further object of the invention is to provide the users with a modular element for making fixed ladders suitable for ensuring high level of resistance and reliability over time, also such as to be easily and inexpensively constructed.

These and other objects are achieved by the modular element for making fixed ladders of this invention which, made of steel or other suitable material, is essentially characterised in that it comprises a surface and two opposite shaped supports, provided with at least one rib developed along the inner face and forming a shelf for bearing a further surface.

BRIEF DESCRIPTION OF DRAWINGS

The construction and functional features of the modular element for making fixed ladders of this invention shall be better understood from the following detailed description, wherein reference is made to the annexed drawing tables showing a preferred and non-limiting embodiment as well as a variant thereof and wherein:

FIG. 1 schematically shows a perspective view of the modular element for making fixed ladders of this invention, assembled in the various components thereof according to an exemplifying and not critical embodiment thereof;

FIG. 3 schematically shows a perspective view of a ladder obtained by assembling different modular elements according to the invention;

FIG. 4 schematically shows a side view of one of the components of the modular element of this invention;

DISCLOSURE OF INVENTION

With initial reference to FIG. 1, the modular element for making fixed ladders of this invention, globally indicated with 10, comprises a surface 12 and two opposite shaped supports 14, 16, each constrained to a side of the surface 12. The said latter is advantageously made by moulding and bending of sheet steel of suitable thickness, by way of an example comprised between 2.0 and 5.0 mm. The surface 12, which makes up the step whereon the foot is supported, has the typical configuration with rectangular plan and is bent at 90° downwards along the entire perimeter defined by two opposite longer and shorter sides.

Figure 2:
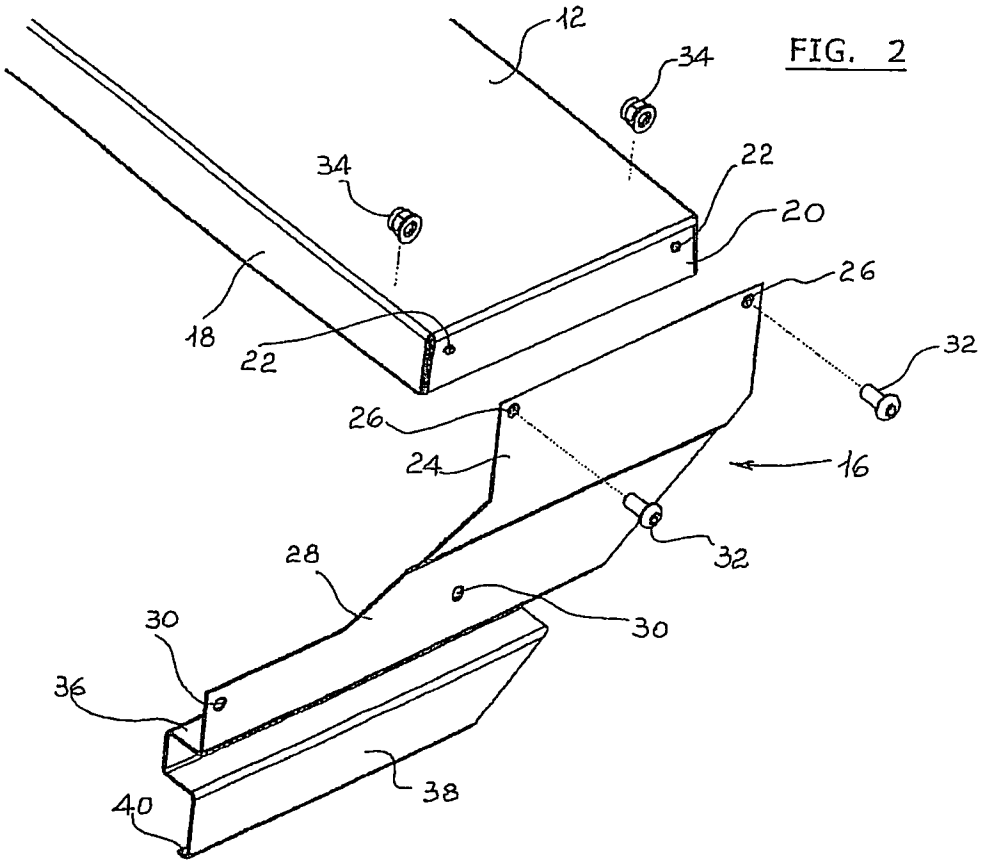
FIG. 2 schematically shows a partial perspective and exploded view of the same modular element.
Figure 5:
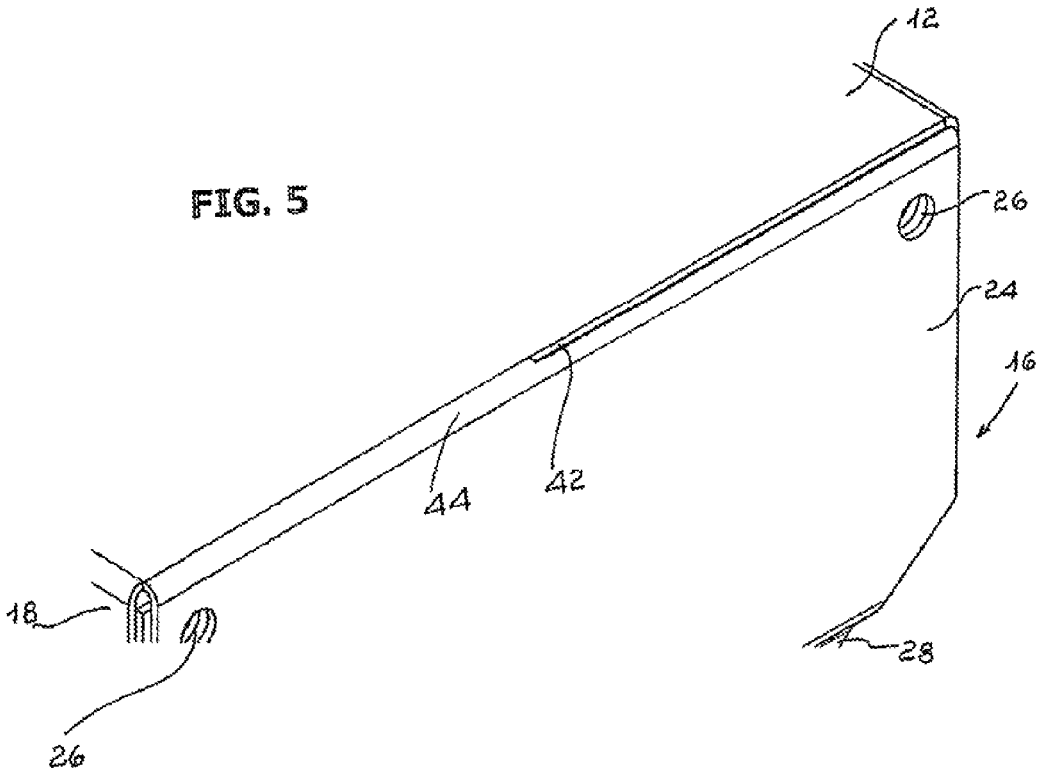
FIG. 5 schematically shows a partial perspective view of the modular element for fixed ladders according to an alternative and preferred embodiment of the invention.
Figure 7:
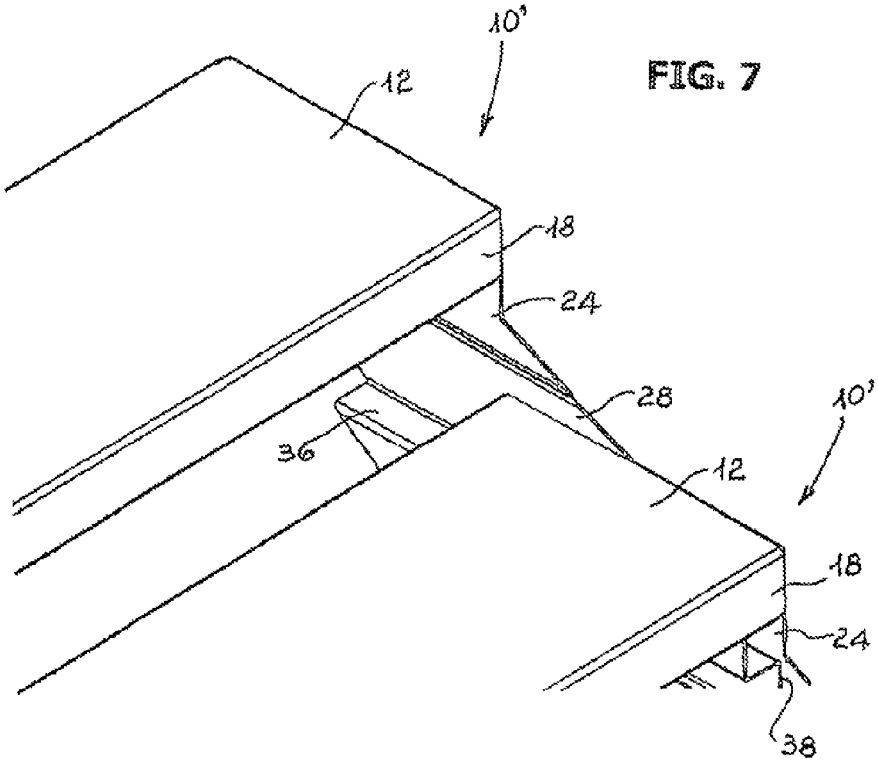
FIG. 7 schematically shows a partial perspective view of two modular elements coupled to one another according to said preferred embodiment of the invention.

Such bending, which has a height indicatively comprised between 25.0 and 80.0 mm, is indicated with 18 at FIGS. 1, 2 and 3 as regards one of the longer sides and with 20 at FIG. 2 as regards one of the shorter sides. The bending 20 of both opposite shorter sides of the surface 12 is provided with two or more through holes 22 for fixing the respective shaped supports 14 and 16 by screws 32 with relevant nuts 34 or equivalent retain means.

The shaped supports 14 and 16, equally preferably made of steel, define as many shoulders or sides of the surface 12 and like the latter, they are advantageously obtained by moulding and bending some parts thereof. Said shaped supports are fixed to the opposite bends 20 of the surface 12 starting from an upper zone 24 wherein the supports themselves have a basically rectangular shape and wherein through openings or holes 26 complementary to the holes 22 of said bends 20. Said upper zone 24 of the shaped supports 14 and 16 has a length equal to that of bends 20 and greater height than the same, which are thus completely covered when the assembly is completed.

Underneath the zone 24, the shaped supports 14 and 16 develop in an integral portion that protrudes in front of the surface 12 and underneath thereof, forming a polygonal band 28 provided with two or more through holes 30 similar to holes 26 of the upper zone 24.

Below the polygonal band 28, the shaped supports 14 and 16 form a rib that defines an integral shelf 36 made by subsequent bends at 90° of the sheet; according to an exemplifying embodiment, a first bend is oriented inwards of the supports 14 and 16, that is, in the direction of the surface 12 and extends by a depth indicatively comprised between 20.0 and 60.0 mm. A second bend, orthogonal relative to the first one, is oriented downwards, that is, is a direction opposite the surface 12, and preferably extends by a height level similar to the previous one. A third bend develops outwards, parallel to the first one, in opposite direction and with the same dimensions thereof. Starting from this third bend, the supports 14 and 16 define an integral final bending edge 38 downwards, with optional end edge 40 oriented inwards by a limited extent, parallel to shelf 36.

Said latter, as schematised in particular at FIGS. 1 and 4, extends in longitudinal direction preferably by the entire width of the polygonal band 28.

The shelf 36, obtained along the inner faces of both shaped supports 14 and 16, thus forms opposite planes, parallel to the surface 12, whereon a further surface 12 rests with the lower edge defined by the bends 20 and by a part of the bends 18. The through holes 30 made along the polygonal band 28 of the shaped supports 14 and 16 are suitable for aligning with the holes 22 of the further surface 12 for the fixing thereof by screws 32 and relevant nuts 34; said holes 30 are made in such position as to fix the second surface 12 relative to the first one, as well as the subsequent ones, at a predetermined distance from each other, according to the regulations in force, also keeping a predetermined height, or rise, between the surfaces 12 that form the steps. The surfaces 12, as can be seen from FIG. 3, are suitably stabilised as they rest on the shelves 36 and are constrained by the screws 32 and the nuts 34 to the shaped supports 14 and 16. A ladder thus made can comprise an indefinite number of surfaces 12, thus of steps, the first one and the last one whereof are fixed to the ground and at the top of the structure the ladder is associated to in a known manner, for example by bolts and nuts in the case of steel flooring and metalwork slabs, or by screw anchors in the presence of reinforced concrete flooring and slabs.

FIGS. 5 to 8 show an alternative and preferred solution of the modular element for making fixed ladders of this invention. In said figures, the same reference numerals of the solutions described above are used for common parts or components, whereas the modular element is globally indicated with 10'.

Figure 6:
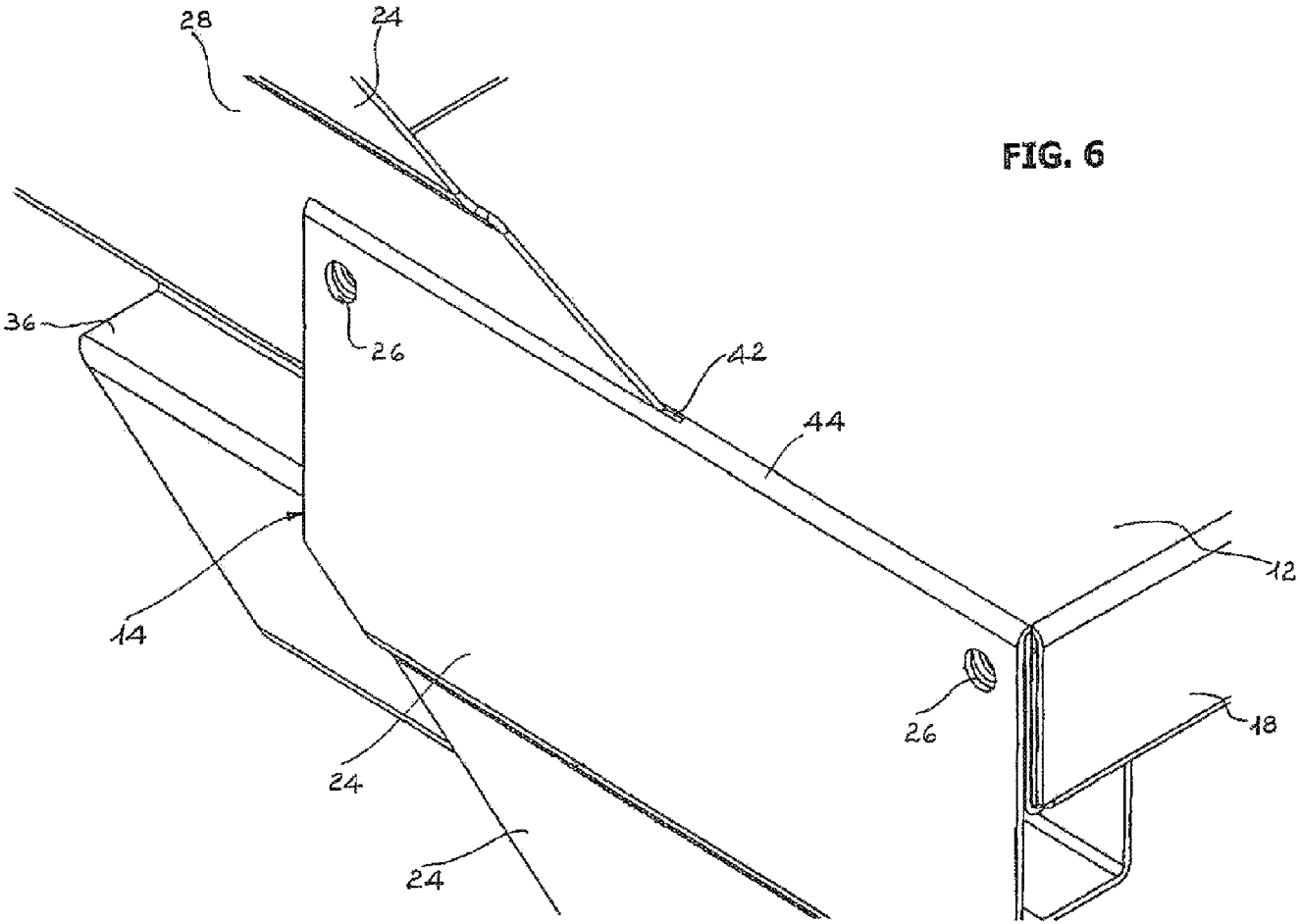
FIG. 6 schematically shows a partial perspective view of a modular element coupled to a further and identical modular element according to said preferred embodiment of the invention.
Figure 8:
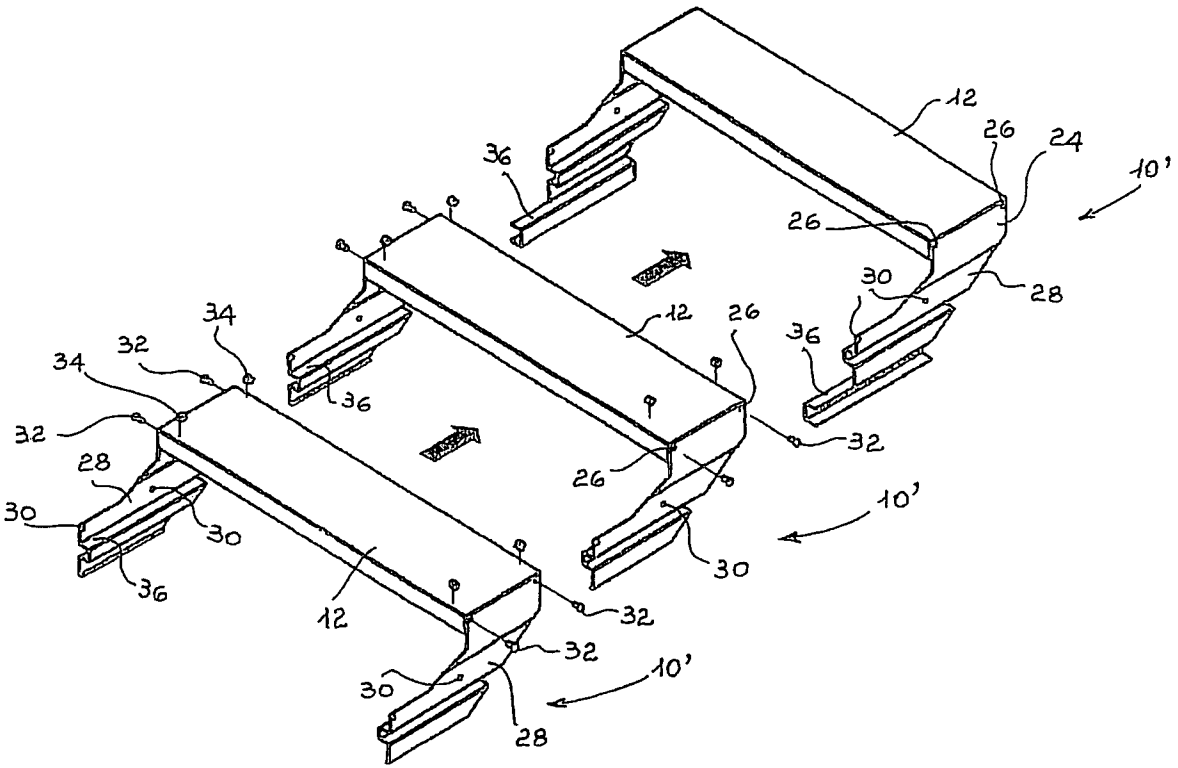
FIG. 8 schematically shows the exploded perspective view of three modular elements in a reciprocal coupling step for obtaining a ladder according to said preferred embodiment of the modular elements themselves.

According to such alternative and preferred solution, the surfaces 12 and the opposite shaped supports 14 and 16 are obtained in a single body by moulding and subsequent bends of the base sheet, as may be seen for example from FIG. 6; each modular element 10 thus formed is suitable for partially penetrating into the underlying one when they are assembled to one another for progressively making a ladder.

Such reciprocal penetration takes place at a slit 42 obtained on the opposite sides of the modular element 10 in the union zone or bending line, indicated with 44, existing between the surface 12 and the shaped supports 14, 16.

The slit 42 is obtained by moulding or shearing and is in the above position following the downward bend at 90° of the starting sheet for forming said shaped supports as a single body with the surface 12. The union zone 44 or bending line that defines such bend is advantageously provided with slight radiusing.

The longitudinal extension of the slit 42, the width whereof substantially matches the thickness of the sheet forming the modular elements 10, is equal to about half the length of the surfaces 12; said slit also extends vertically, in the part comprised between shaped support 14 or 16 and one of the bends 18 of the surface 12, and forms the seat for the introduction of the polygonal band 28 of a further and overlying modular element 10. This configuration can be seen from FIGS. 5, 6 and 7. In the assembly step, the holes 30 of the polygonal bands 28 inserted laterally in the slit(s) 42 and belonging to the shaped supports 14, 16 of a modular element 10, are made to coincide with the holes 26 made along the zone 24 of the shaped supports 14, 16 belonging to the overlying modular element 10.

The screws 32 are arranged in the holes thus aligned, tightened with nuts 34 for quickly and easily locking and compacting to one another the two overlapping modular elements 10. As in the exemplifying solution described above, also in this preferred embodiment the surface 12 of a modular element 10 rests laterally on the opposite shelves 36 made along the shaped supports 14 and 16 of the overlying modular element 10; this can be seen, in particular, from FIGS. 6, 7 and 8.

As can be noticed from the above, the advantages achieved by the invention are clear.

The modular element of this invention allows making and quickly installing metal ladders, both outside and inside buildings, thanks to the setup of the shaped supports 14, 16 with shelves 36 for resting the surfaces 12; advantageously, each pair of modular elements 10 can be coupled by only four screws and relevant nuts, without the need of welds and bulky bearing structures to fix the steps to. Said last ones, corresponding to the surfaces 12, may have different finishes of the walking surface, for example pierced, rusticated, non-slip, screened, etc.

Moreover and particularly advantageous, according to the preferred solution described above, is making the modular elements 10 in a single body starting from sheet with simple operations of moulding, bending and/or shearing for obtaining the slits 42; said modular elements thus obtained and assembled with one another result in very compact and sturdy ladders, besides simple to be mounted on site.

Even if the invention has been described hereinbefore with particular reference to an embodiment thereof made by way of a non-limiting example, several changes and variations will appear clearly to a man skilled in the art in the light of the above description. This invention therefore is intended to include any changes and variations thereof falling within the spirit and the scope of protection of the following claims.

The invention claimed is:

1. A modular element (10) for making fixed ladders, made of steel comprising:

a step surface (12) and two opposite shaped supports (14, 16), each shaped support having an upper zone (24) adjacent to the step surface (12) and an inferior opposite edge (38), each of said shaped supports having a "C" shaped folding developed towards the opposite shaped support, the "C" shaped folding formed between said upper zone (24) and the inferior opposite edge (38), a superior face of each "C" shaped folding forming a shelf (36) for bearing another step surface thereon.

2. The modular element of claim 1 wherein the step surface and the two opposite shaped supports are made of steel.

3. The modular element of claim 1, wherein said opposite shaped supports (14,16) are integrally formed with the step surface (12), each shaped support joined to the step surface via a downwardly bent portion, bent relative to the step surface at 90 degrees along a bending line (44), a slit (42) provided along part of the bending line.

4. The modular element according to claim 3, wherein said upper zones (24) of each shaped support has a substantially rectangular shape, the upper zone provided with two or more through holes (26), an integral polygonal band (28) disposed beneath the upper zone and which extends underneath the step surface (12), the polygonal band having two or more through holes (30), the polygonal band (28) being adapted for insertion into a slit (42) of another modular element, such that the through holes (26) in an upper zone of the other modular element align with the through holes (30) of the polygonal band (28).

5. The modular element according to claim 4, wherein screws (32) are inserted into the aligned holes (26) and (30) for connecting the modular elements together.

6. The modular element according to claims 1, wherein the step surface (12) has a rectangular shape, bent faces disposed along opposite longer sides thereof, the bent faces bent downwards at 90 degrees relative to the step surface, and having a height of between 25.0 and 80.0 millimeters.

7. The modular element according to claim 6, wherein the slit (42) has an extension equal to about half a length of the bending line (44), the slit extending vertically downwardly between each shaped support (14, 16) and a rearward bent face (18) of the step surface (12).

8. The modular element according to claim 4, wherein said "C" shaped folding defining said shelves (36) are disposed beneath said polygonal bands and receive bent faces of the another step surface thereon.

9. The modular element according to claim 8, wherein the shelves (36) extend for an entire length of each polygonal band (28).

10. The modular element according to claim 1, wherein each "C" shaped folding comprises a plurality of 90 degree bends formed in a sheet.

11. The modular element according to claim 1, wherein each said inferior opposite edge (38) has an end edge (40) oriented inwards, parallel to each said shelf (36).

12. The modular element according to claim 1, wherein each shaped support (14, 16), comprising the upper zone (24), the polygonal band (28) and the "C" shaped folding forming the shelf (36), are made separately from the step surface (12), each step surface having opposite shorter sides (20) bent downwards, positioned adjacent to the upper zones of each shaped support.

13. The modular element according to claims 12, wherein said sides (20) and said upper zones are provided with holes (22), adapted for aligning each upper zone (24) with the shorter sides for receiving screws (32) for connecting said shaped supports (14, 16) to the step surface (12).

* * * * *